US012590778B2

(12) United States Patent
Chang

(10) Patent No.: US 12,590,778 B2
(45) Date of Patent: Mar. 31, 2026

(54) STRING-UNLOADING APPARATUS OF A CROSSBOW

(71) Applicant: COMBIS SPORT ENTERPRISE CO., LTD., Taichung City (TW)

(72) Inventor: Chu-Wei Chang, Taichung City (TW)

(73) Assignee: Combis Sport Enterprise Co., Ltd., Taichung City (TW)

( * ) Notice: Subject to any disclaimer, the term of this patent is extended or adjusted under 35 U.S.C. 154(b) by 214 days.

(21) Appl. No.: 18/663,957

(22) Filed: May 14, 2024

(65) Prior Publication Data

US 2025/0354775 A1 Nov. 20, 2025

(51) Int. Cl.
*F41B 5/14* (2006.01)
*F41B 5/12* (2006.01)

(52) U.S. Cl.
CPC ..... *F41B 5/1469* (2013.01); *F41B 5/12* (2013.01)

(58) Field of Classification Search
CPC ..... F41B 5/1469; F41B 5/12; F41B 5/123
USPC ..... 124/31
See application file for complete search history.

(56) References Cited

U.S. PATENT DOCUMENTS

| | | | | |
|---|---|---|---|---|
| 9,360,268 | B2 | 6/2016 | Khoshnood | |
| 10,508,884 | B1 * | 12/2019 | Chen | F41A 17/46 |
| 10,866,055 | B1 * | 12/2020 | Hensel | F41B 5/12 |
| 11,002,505 | B1 * | 5/2021 | Shaffer | F41B 5/1469 |
| 11,428,499 | B2 * | 8/2022 | Shaffer | F41B 5/12 |
| 11,808,545 | B1 * | 11/2023 | Chu | F41B 5/1469 |
| 12,487,049 | B2 * | 12/2025 | Chang | F41B 5/12 |
| 2021/0348875 | A1 * | 11/2021 | Bednar | F41B 5/123 |

FOREIGN PATENT DOCUMENTS

| | | | | |
|---|---|---|---|---|
| TW | 207344 U | | 6/1993 | |
| TW | I662245 B | | 6/2019 | |
| WO | WO2024/077394 | * | 4/2024 | F41B 5/1469 |

* cited by examiner

*Primary Examiner* — John E Simms, Jr.

(57) ABSTRACT

A crossbow includes a string, a trigger assembly, a safety and a string-unlocking apparatus. Only one hand is required to use a cocking device to operate the string-unlocking apparatus to move the safety to an unlocking position from a locking position and to pivot the trigger assembly to a discharging position from a hooking position.

6 Claims, 17 Drawing Sheets

STRING-UNLOADING APPARATUS OF A CROSSBOW

BACKGROUND OF INVENTION

1. Field of Invention

The present invention relates to a crossbow and, more particularly, to a string-unloading apparatus of a crossbow.

2. Related Prior Art

As disclosed in Taiwanese Patent No. 207344, a crossbow includes a barrel, two limbs transversely connected to a front section of the barrel, a string tied to the limbs, and a trigger pivotally connected to a rear section of the barrel. The string is loaded and held by the trigger before an arrow is loaded on the barrel. Then, the trigger is operable to release the string to shoot the arrow. Details of such a trigger can be seen in Taiwanese Patent 1662245 for example.

However, sometimes, there is no proper target or environment for shooting after the arrow and the string are loaded. Hence, the arrow and the string have to be unloaded.

To this end, the trigger is operable to release the string to shoot the arrow at a soft object. However, this inevitably damages the arrow.

Alternatively, the trigger is operable to release the string after the arrow is unloaded. However, this inevitably damages the crossbow.

Alternatively, an archer uses one hand to operate the trigger and uses the other hand to operate a cocking device to pull the string so that the archer slowly and gently unloads the string. However, this practice is inconvenient for the archer for he or she has to use both hands.

To solve the above-mentioned problems, devices have been devised such as in U.S. Pat. Nos. 11,002,505 and 9,360,268. However, the structures of these devices are complicated and the operations of these devices are inconvenient.

The present invention is therefore intended to obviate or at least alleviate the problems encountered in the prior art.

SUMMARY OF INVENTION

It is the primary objective of the present invention to provide a simple and convenient string-unloading apparatus for a crossbow.

To achieve the foregoing objective, the string-unloading apparatus includes a box, a trigger unit, a string-hooking unit and an unloading unit. The box includes a chamber, two fletching-receiving slits in communication with the chamber, a nock-receiving hole in communication with the fletching-receiving slits, a trigger-receiving slot in communication with the chamber, an irregular hole cut in an internal portion of the box and in communication with the chamber, a confining orifice in communication with the chamber, and a pusher-receiving groove cut in another internal portion of the box and in communication with the chamber and the confining orifice. The irregular hole includes a first recess, a second recess and a third recess. The trigger unit includes a trigger and a trigger-biasing spring. The trigger extends from the chamber via the trigger-receiving slot, and includes a first section formed with a bore and a second section formed with a protuberance. The trigger-biasing spring includes an end in contact with another internal portion of the box and another end in contact with the first section of the trigger, thereby pivoting the second section of the trigger upward.

The string-hooking unit includes a hook, a shaft and a hook-biasing spring. The hook includes a shank and a stopping portion. The shank includes an orifice and a boss in vicinity of an end and a claw extending from another end. The stopping portion extends from the shank into the bore. The shaft extends throughout the third orifice to pivotally connect the hook to the box. The hook-biasing spring extends around the pivot, and includes an end in contact with an internal portion of the box and another end in contact with the stopping portion, thereby lifting the claw. The unloading unit includes a pusher, a handle, an internal connector and a leaf spring. The pusher is movable in the pusher-receiving groove, and includes an end for abutment against the boss and a stepped pocket near another end. The handle includes an end connected to the pusher and another end extending from the chamber via the confining orifice. The internal connector includes two pivots. The first pivot extends from a side of the internal connector, and is movable between the first and third recesses via the second recess. The shank is operable to lift the first pivot to the third recess from the second recess. The second pivot extends from another side of the internal connector, and is movable between shallow and deep portions of the stepped pocket. The slot receives the protuberance of the trigger to selectively actuate the trigger. The leaf spring includes a rectilinear section connected to the box and a bent section in contact with an upper section of the internal connector, thereby moving the first pivot between the first and third recesses via the second recess.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
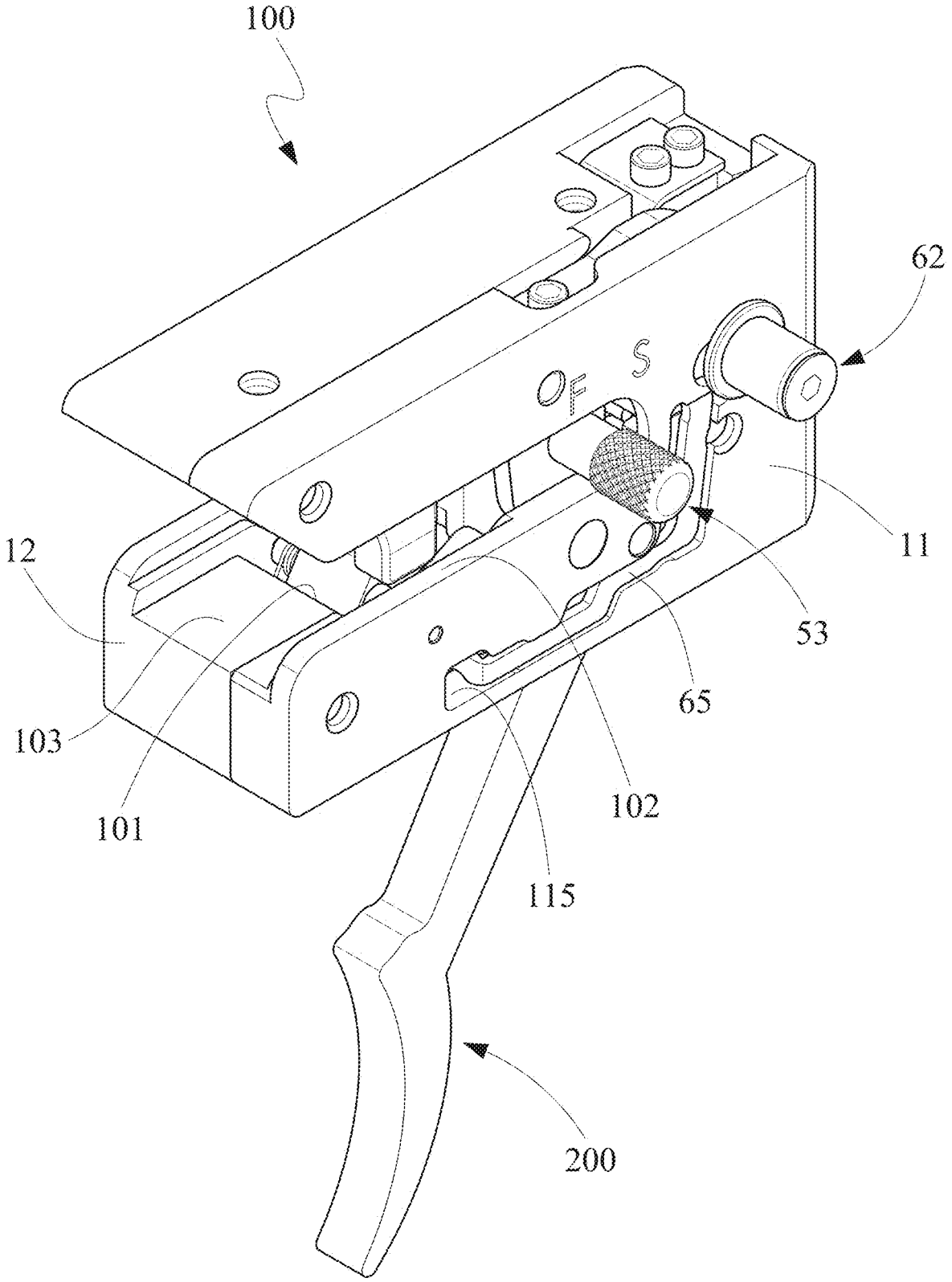
FIG. 1 is a perspective view of a string-unloading apparatus according to the preferred embodiment of the present invention.

Referring to FIGS. 1 through 7, a string-unloading apparatus includes a box 100, a trigger unit 200, a string-holding unit 300, a string-hooking unit 400, a safety unit 500 and an unloading unit 600 according to the preferred embodiment of the present invention.

Referring to FIGS. 1 through 6, the box 100 is intended to be located in a barrel of a crossbow (not shown). The box 100 is made by connecting two shells 11 and 12 to each other. The box 100 includes a chamber 101, two fletching-receiving slits 102, a nock-receiving hole 103, a trigger-receiving slot 104, two spring-receiving holes 111 and 121, an irregular hole 112, a confining orifice 113, a pusher-receiving groove 114, a channel 115, and two apertures 116 and 117.

Referring to FIG. 1, the chamber 101 is cut in the box 100 as in the prior art.

Referring to FIG. 1, the fletching-receiving slits 102 are respectively cut in the shells 11 and 12 as in the prior art. The fletching-receiving slits 102 are in communication with the chamber 101.

Referring to FIG. 1, the nock-receiving hole 103 is located between and in communication with the fletching-receiving slits 102 as in the prior art.

Figure 5:
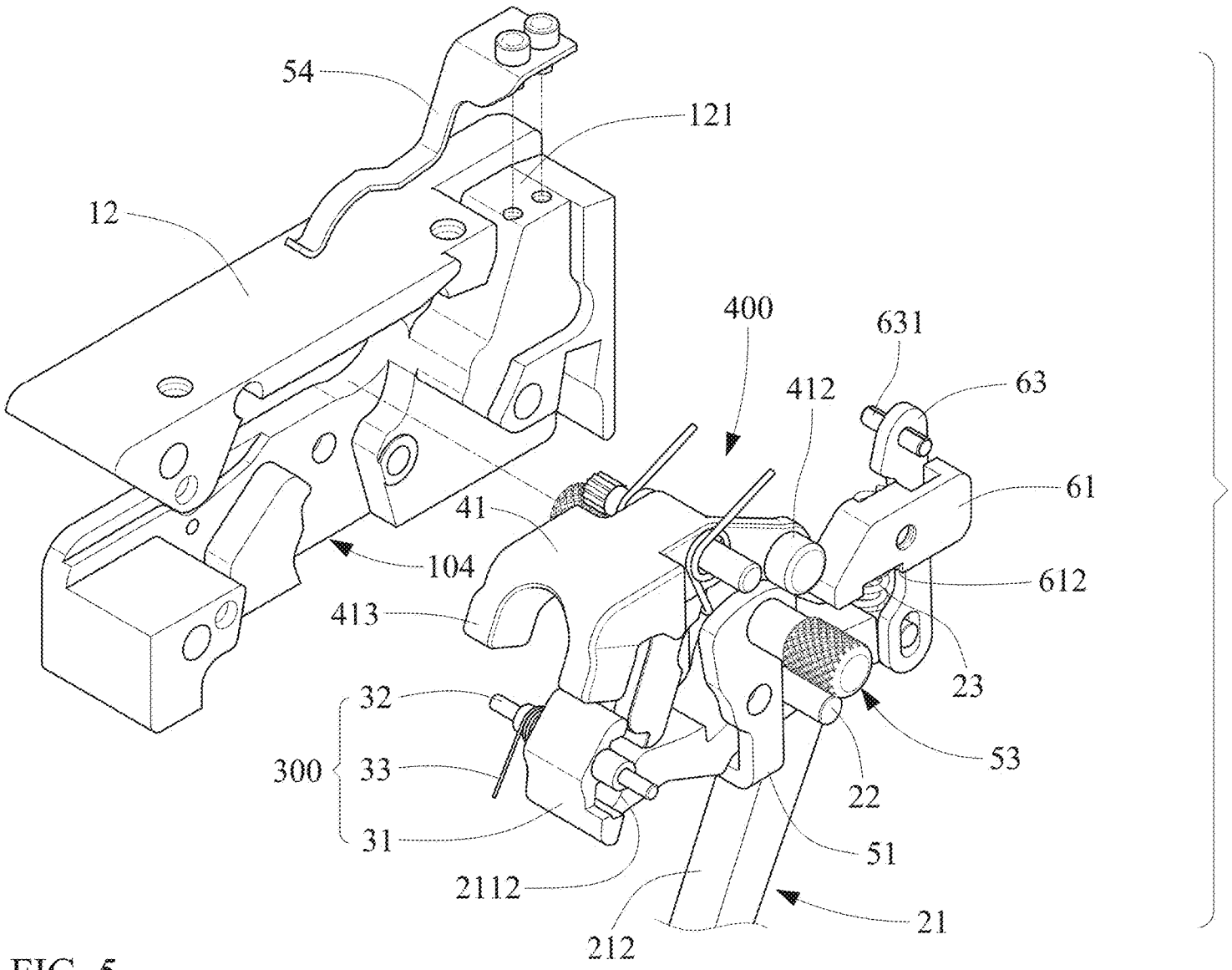
FIG. 5 is an exploded partial view of the string-unloading apparatus shown in FIG. 3.
Figure 6:
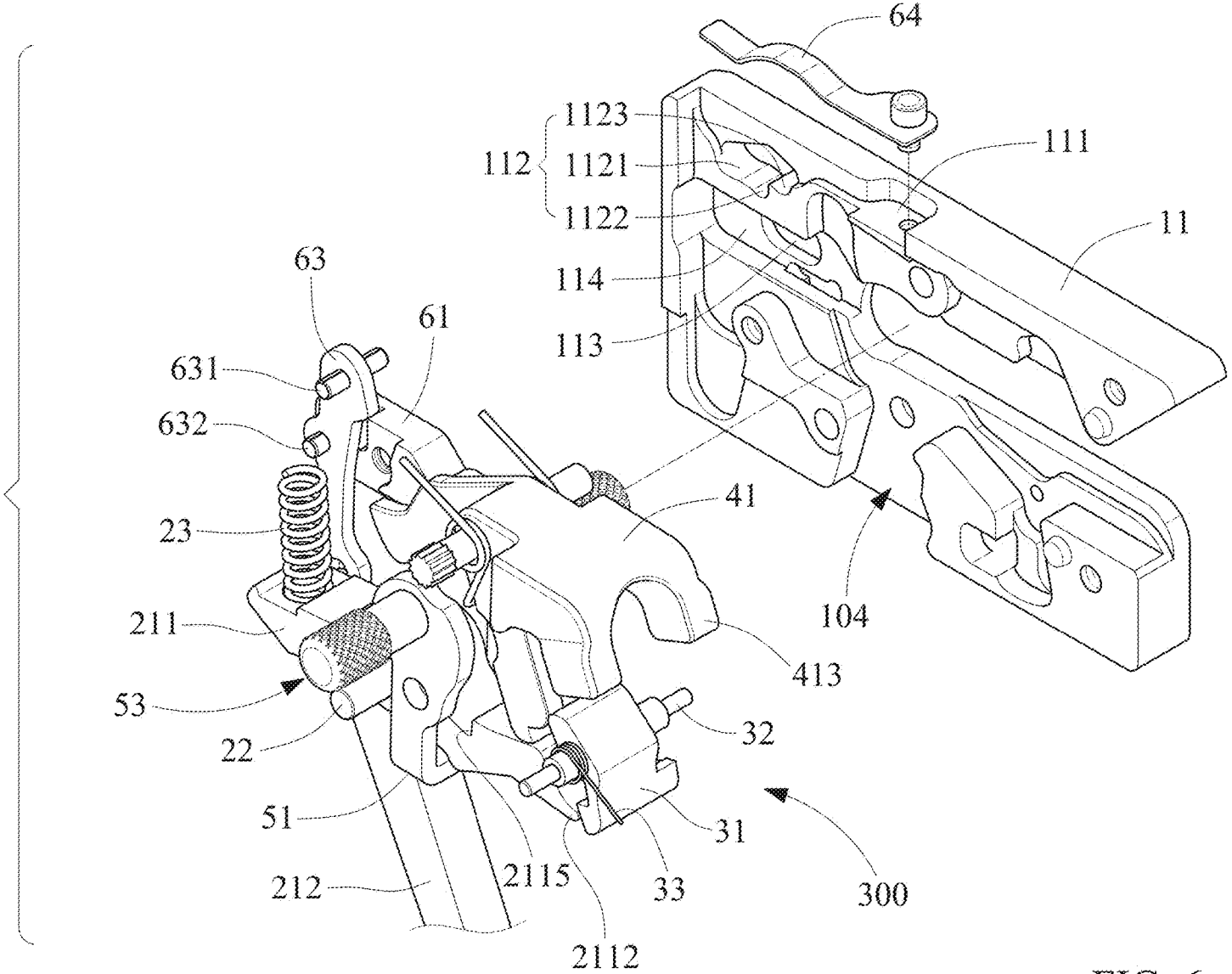
FIG. 6 is an exploded partial view of the string-unloading apparatus shown in FIG. 4.

Referring to FIGS. 5 and 6, the trigger-receiving slot 104 is cut in a lower portion of the box 100 as in the prior art. The chamber 101 is in communication with the exterior of the box 100 via trigger-receiving slot 104.

Referring to FIGS. 5 and 6, the spring-receiving hole 111 is cut in an upper portion of the shell 11. The chamber 101 is in communication with the exterior of the box 100 via the spring-receiving hole 111.

Referring to FIGS. 5 and 6, the spring-receiving hole 121 is cut in an upper portion of the shell 12. The chamber 101 is in communication with the exterior of the box 100 via the spring-receiving hole 121.

Referring to FIG. 6, the irregular hole 112 is cut in an internal lateral face of the shell 11. The irregular hole 112 is in communication with the chamber 101. The irregular hole 112 is in communication with three recesses 1121, 1122 and 1123 cut in a lower section of a periphery around the irregular hole 112.

Figure 2:
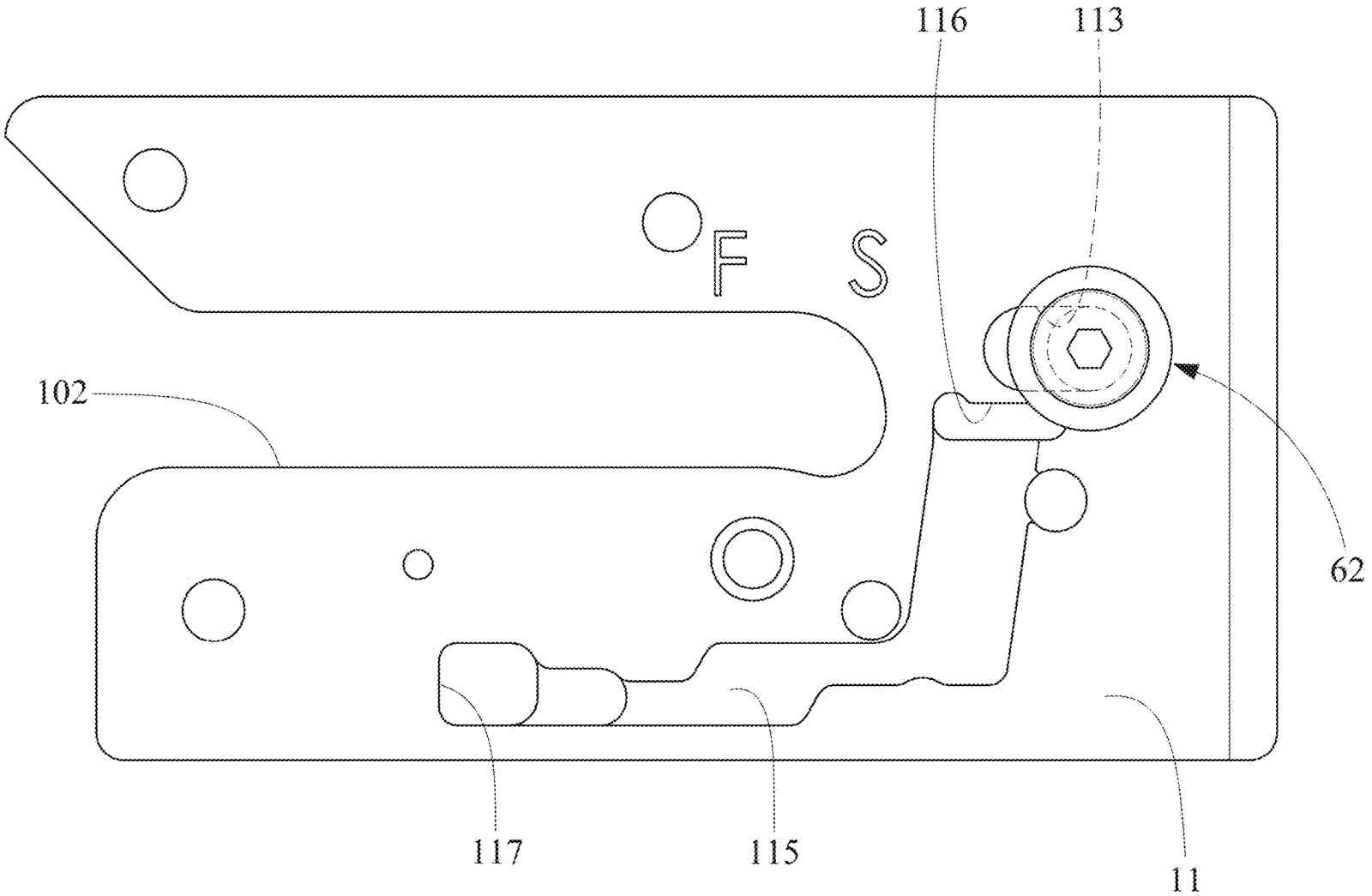
FIG. 2 is a side view of the string-unloading apparatus shown in FIG. 1.
Figure 3:
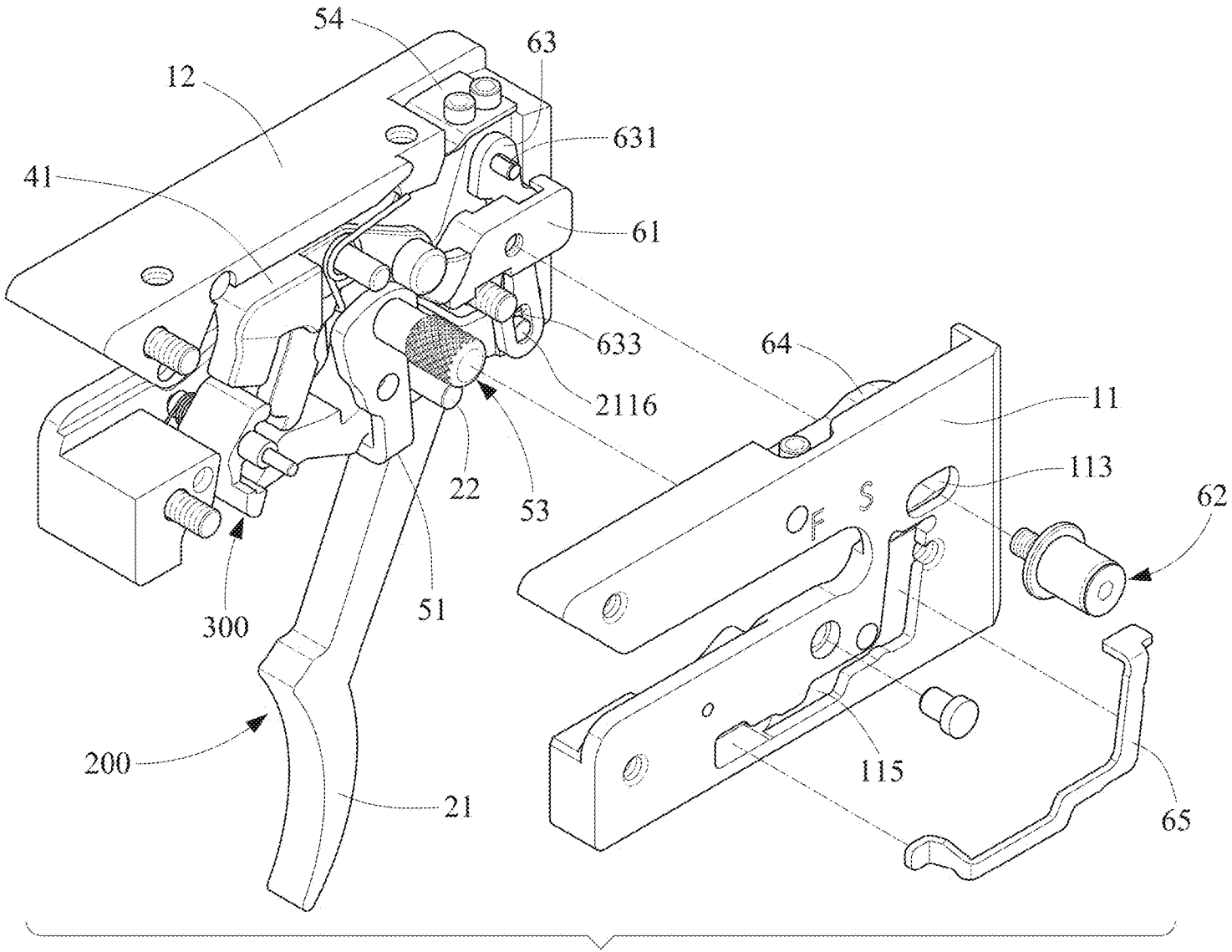
FIG. 3 is an exploded view of the string-unloading apparatus shown in FIG. 1.

Referring to FIGS. 2, 3 and 6, the confining orifice 113 extends throughout the shell 11. The chamber 101 is in communication with the exterior of the box 100 via the confining orifice 113.

Referring to FIG. 6, the pusher-receiving groove 114 is cut in the internal lateral face in the shell 11. The pusher-receiving groove 114 is in communication with the chamber 101. The confining orifice 113 is located in the pusher-receiving groove 114.

Referring to FIGS. 1 through 3, the channel 115 is cut in an external lateral face of the shell 11. The channel 115 is in communication with the exterior of the box 100.

Referring to FIGS. 1 and 2, the aperture 116 extends throughout the shell 11. The aperture 116 is in communication with both the channel 115 and the pusher-receiving groove 114.

Referring to FIGS. 1 and 2, the aperture 117 extends throughout the shell 11. The aperture 117 is in communication with both the channel 115 and the chamber 101.

Referring to FIGS. 1 and 3 through 8, the trigger unit 200 includes a portion located in the box 100 and another portion extending from the box 100 to be maneuvered by a user of the crossbow. The trigger unit 200 includes a trigger 21, a rod 22 and a trigger-biasing spring 23.

Referring to FIGS. 3 through 7, the trigger 21 includes an end located in and pivotally connected to the box 100 and another end located out of the box 100. The trigger 21 is a substantially T-shaped element including a connective section 211 and a maneuver section 212.

Figure 7:
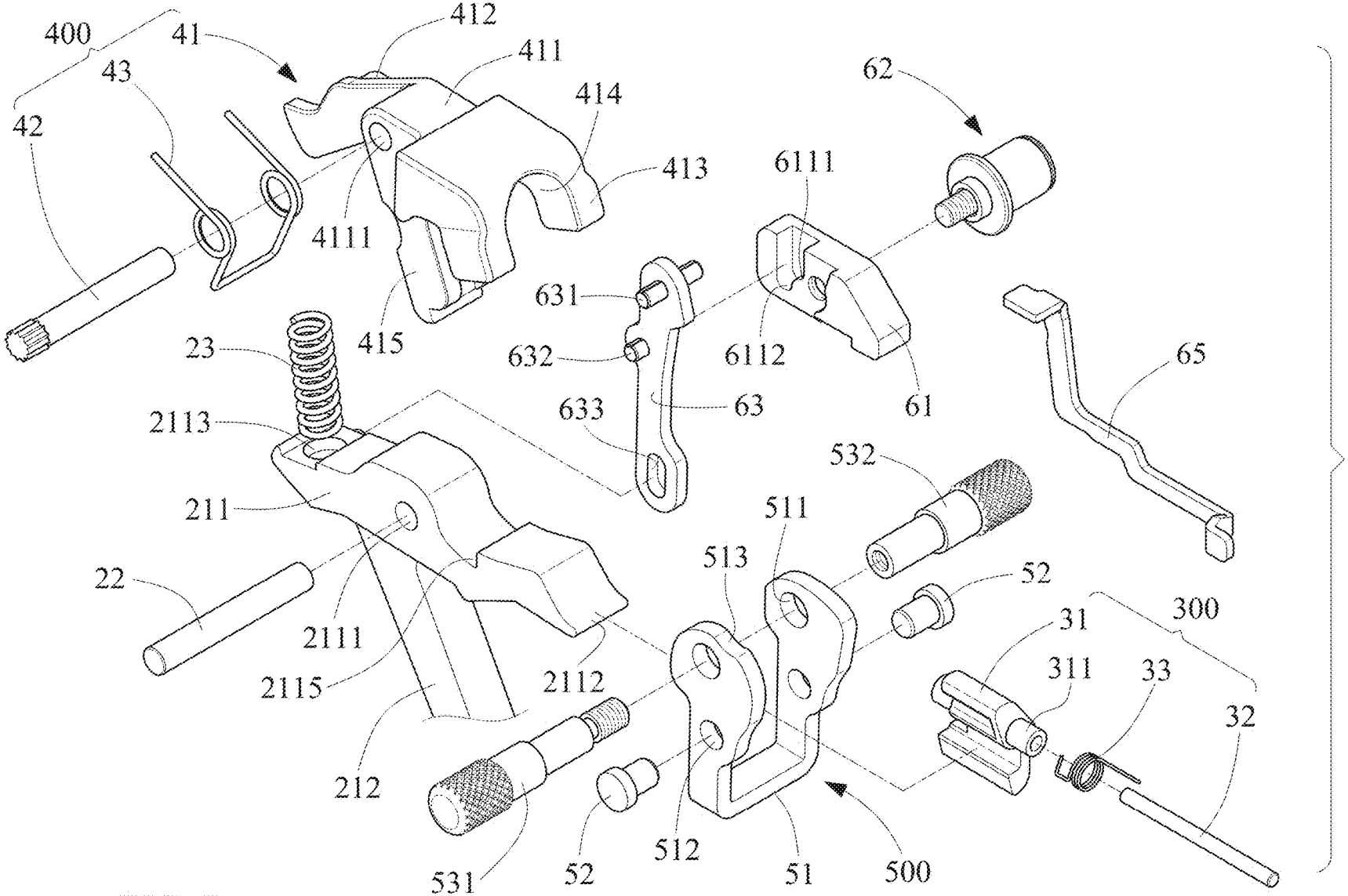
FIG. 7 is an exploded partial view of the string-unloading apparatus shown in FIG. 6.
Figure 8:
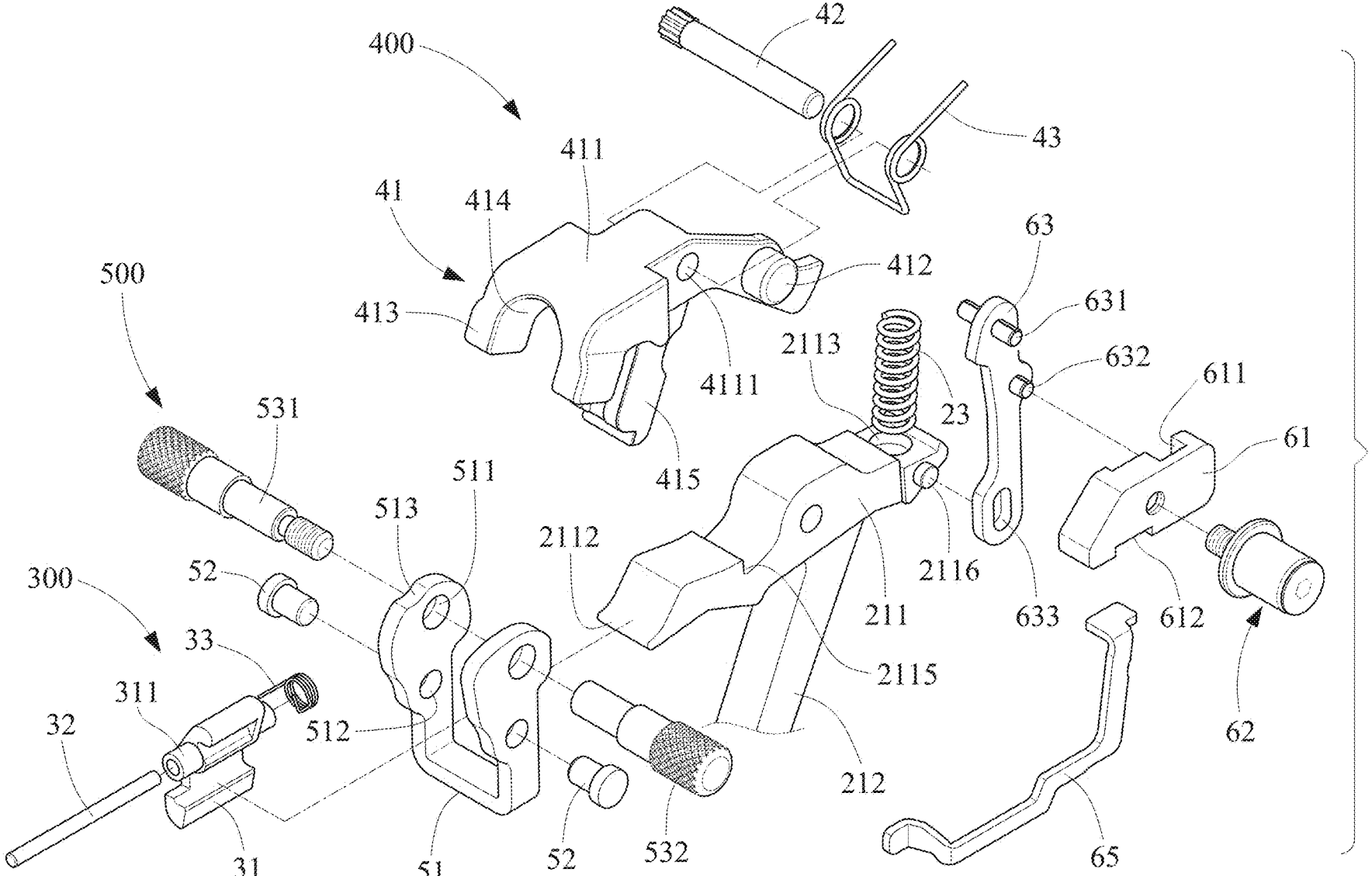
FIG. 8 is an exploded partial view of the string-unloading apparatus shown in FIG. 5.

Referring to FIGS. 7 and 8, the connective section 211 includes an orifice 2111, a pushing portion 2112, a spring-receiving bore 2113, a bore 2115 and a protuberance 2116.

The orifice 2111 horizontally extends throughout the connective section 211.

The pushing portion 2112 is formed at an end of the connective section 211. The spring-receiving bore 2113 is cut in an upper face of the connective section 211, near another end of the connective section 211.

The bore 2115 is cut in the upper face of the connective section 211, adjacent to the pushing portion 2112.

The protuberance 2116 extends from a lateral face of the connective section 211, in vicinity of the spring-receiving bore 2113.

Referring to FIGS. 7 and 8, the maneuver section 212 includes an end connected to the connective section 211 and another end extending to the exterior of the box 100 from the chamber 101 via the trigger-receiving slot 104.

The rod 22 extends throughout the orifice 2111. The rod 22 includes two ends respectively connected to the shells 11 and 12. Thus, the rod 22 pivotally connects the trigger 21 to the shells 11 and 12.

Referring to FIGS. 7 and 8, the trigger-biasing spring 23 includes an end located in the spring-receiving bore 2113 and another end abutted against an internal portion of the box 100 in the chamber 101. Normally, the trigger-biasing spring 23 biases the trigger 21, thereby tending to pivot the pushing portion 2112 upward.

Referring to FIGS. 3 through 8, the string-holding unit 300 is connected to the box 100, in the chamber 101. The string-holding unit 300 is pivotable between an arrow-off position and an arrow-on position. The string-holding unit 300 is operable to prevent the trigger 21 from pivoting in the arrow-off position. The string-holding unit 300 includes a restraint 31, an axle 32 and a restraint-biasing spring 33.

Referring to FIGS. 7 and 8, the restraint 31 is formed with a bushing 311 including two ends respectively extending from two lateral faces of the restraint 31.

Referring to FIGS. 7 and 8, the axle 32 extends throughout the bushing 311. The axle 32 includes two ends respectively connected to the shells 11 and 12.

Referring to FIGS. 7 and 8, the restraint-biasing spring 33 extends around one of the ends of the bushing 311. The restraint-biasing spring 33 is a torque spring including an end abutted against an internal portion of the box 100 in the chamber 101 and another end abutted against a lower portion of the restraint 31. Normally, the restraint-biasing spring 33 tends to pivot the restraint 31 about the axle 32 toward the arrow-off position.

Figure 11:
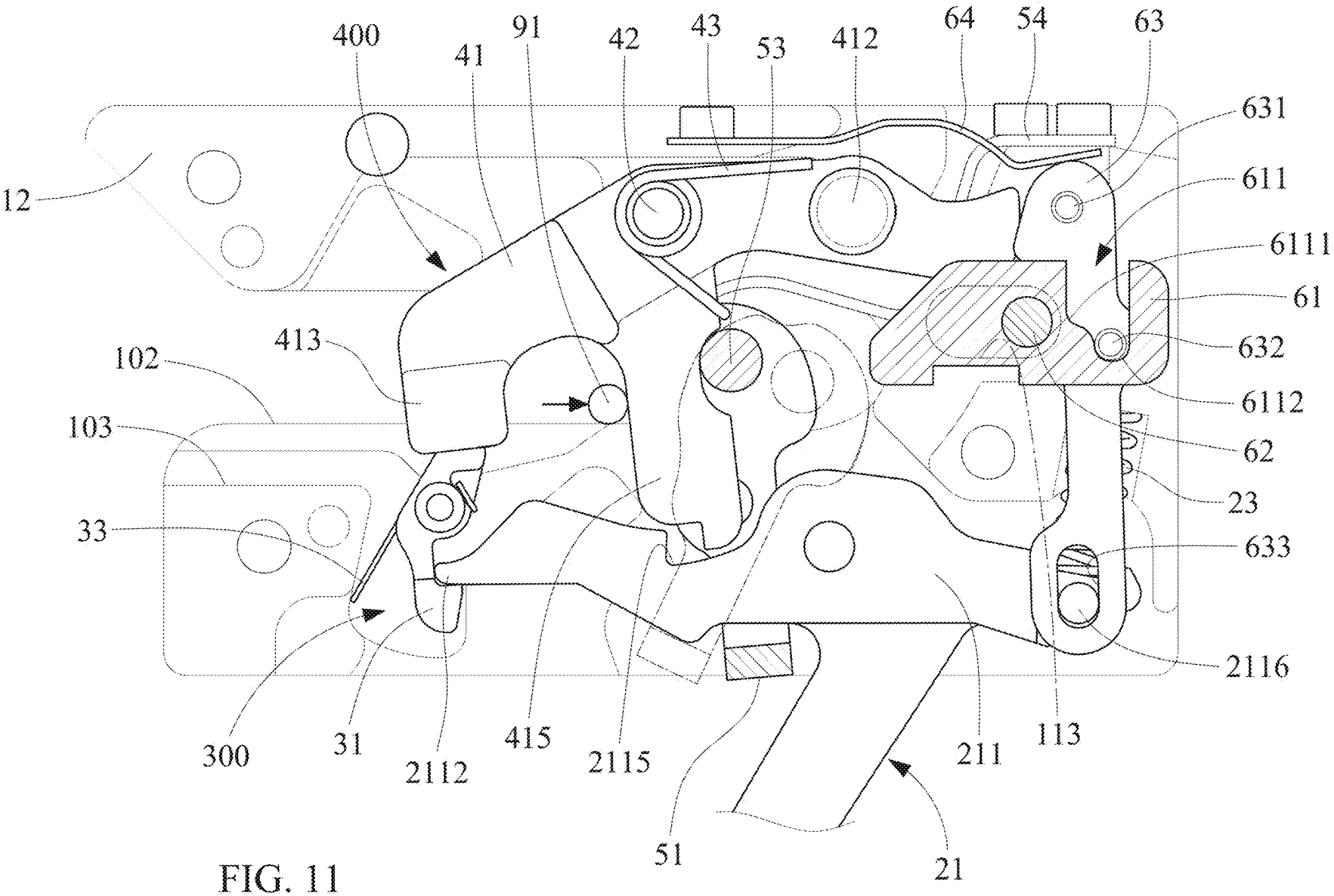
FIG. 11 is a side view of the string-unloading apparatus in another position than shown in FIG. 10.
Figure 12:
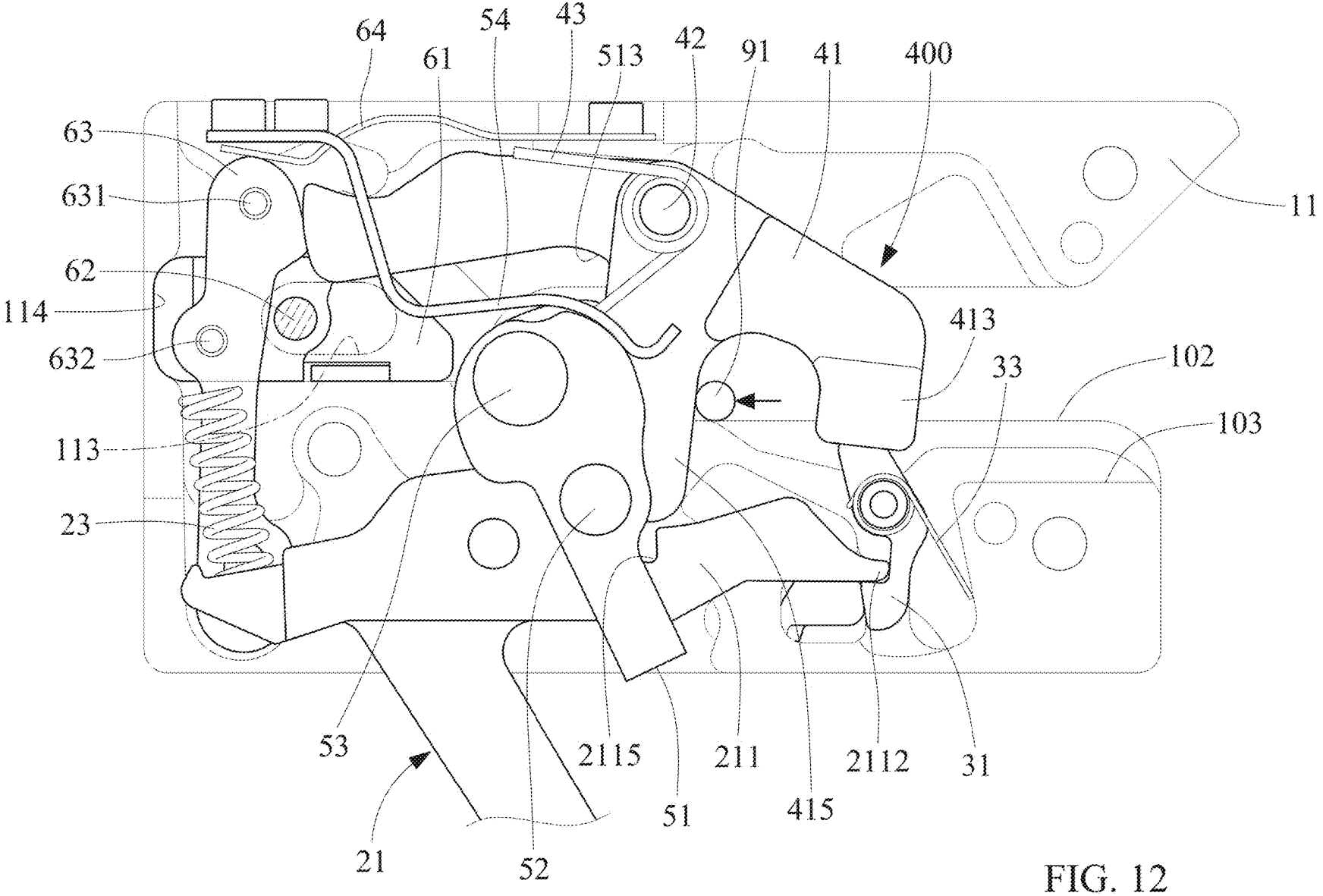
FIG. 12 is a side view of the string-unloading apparatus in another position than shown in FIG. 9.

Referring to FIGS. 11 and 12, in the arrow-off position, the restraint-biasing spring 33 exerts a torque on the restraint 31 to bias an upper portion of the restraint 31 toward the fletching-receiving slits 102 and press the lower portion of the restraint 31 against a lower face of the pushing portion 2112.

Figure 17:
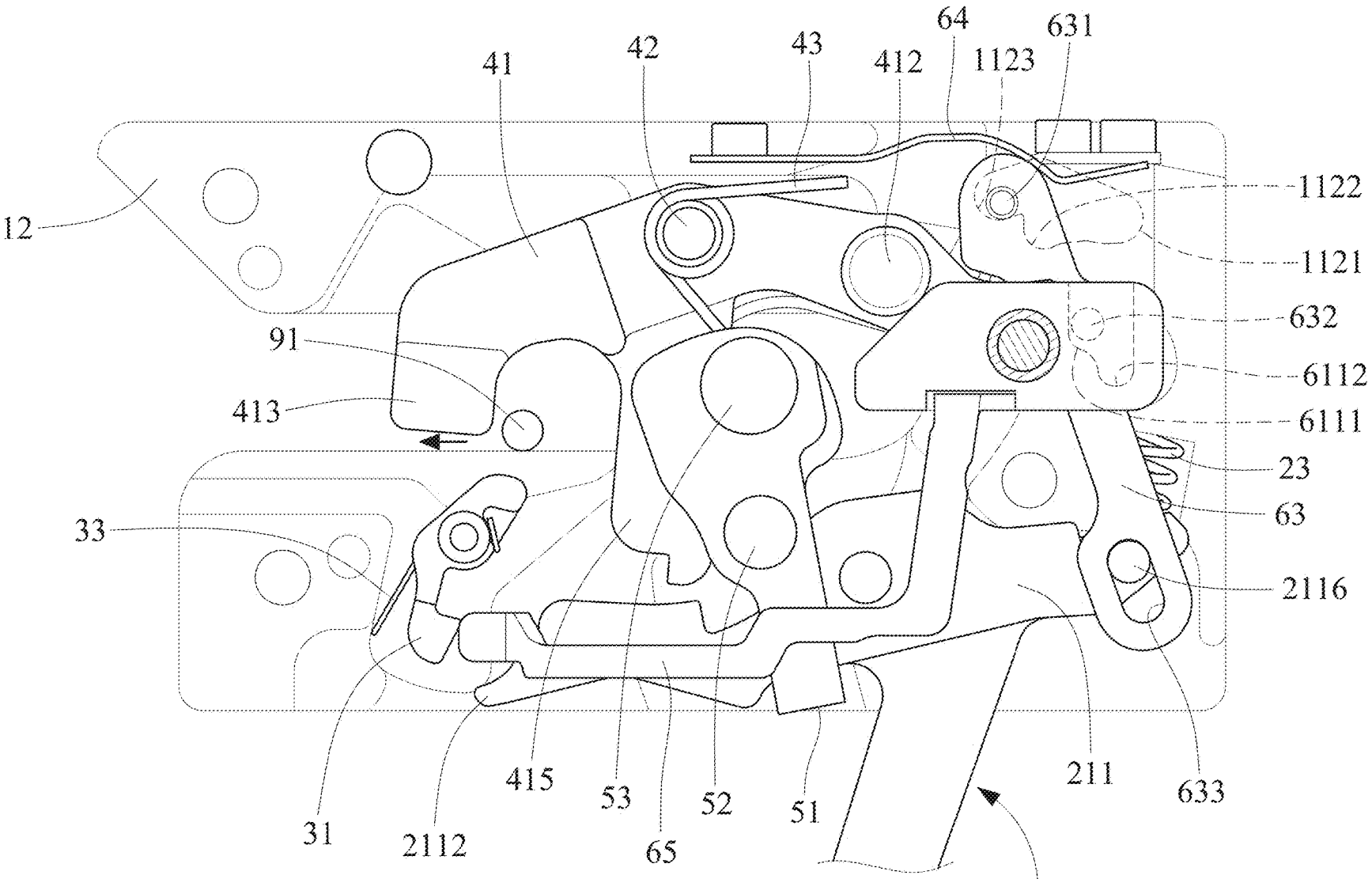
FIG. 17 is a side view of the string-unloading apparatus in another position than shown in FIG. 16.

Referring to FIG. 17, in the arrow-on position, an external torque is exerted on the restraint 31 against the restraint-biasing spring 33 to move the upper portion of the restraint 31 toward a position below the nock-receiving hole 103 and move the lower portion the restraint 31 from the lower face of the pushing portion 2112. Thus, the restraint 31 does not interfere with the movement of the pushing portion 2112 of the trigger 21.

Referring to FIGS. 4 through 8, the string-hooking unit 400 is connected to the box 100, in the chamber 101. The string-hooking unit 400 is movable between a hooking position and a discharging position. The string-hooking unit 400 works with the trigger unit 200 to hook or discharge a string 91 (FIGS. 11 through 17) of the crossbow. The string-hooking unit 400 includes a hook 41, a third shaft 42 and a hook-biasing spring 43.

Referring to FIGS. 7 and 8, the hook 41 includes a shank 411, a boss 412, a claw 413, a cutout 414 and a stopping portion 415.

The shank 411 is formed with an orifice 4111.

The boss 412 extends from a lateral face of a rear section of the shank 411.

The claw 413 extends from a front face of a front section of the shank 411.

The cutout 414 is cut in the claw 413.

The stopping portion 415 extends from a lower face of a middle section of the shank 411. A lower end of the stopping portion 415 is selected abutted against the connective section 211 of the trigger 21 or located in the bore 2115 of the trigger 21.

Referring to FIGS. 7 and 8, the shaft 42 extends throughout the orifice 4111. The shaft 42 includes two ends respectively connected to the shells 11 and 12.

Referring to FIGS. 7 and 8, the hook-biasing spring 43 extends around the shaft 42. The hook-biasing spring 43 is a torque spring including an end abutted against an internal portion of the box 100 in the chamber 101 and another end abutted against the stopping portion 415.

Figure 9:
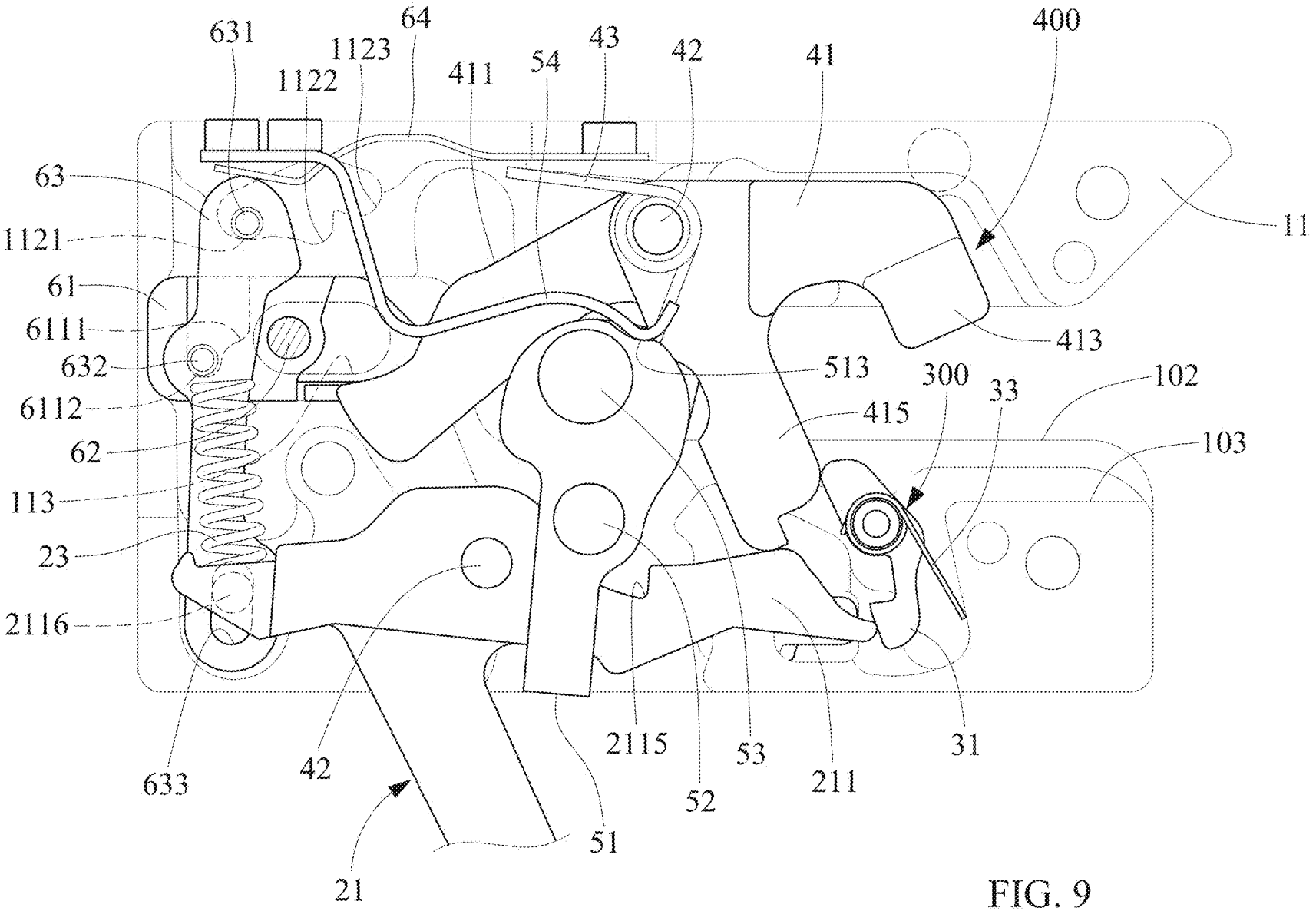
FIG. 9 is a side view of the string-unloading apparatus shown in FIG. 7.
Figure 10:
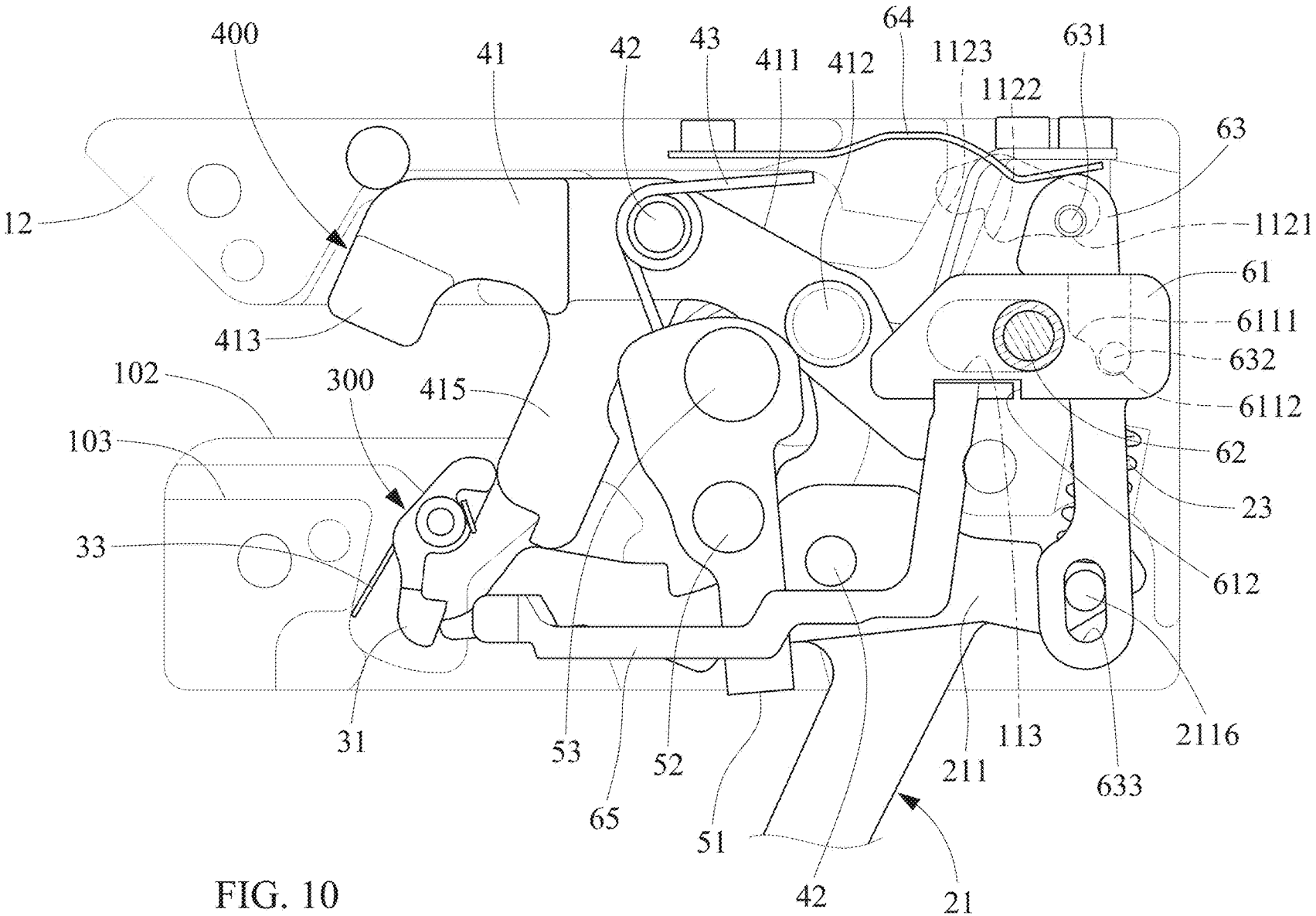
FIG. 10 is a side view of the string-unloading apparatus depicted in FIG. 8.

Referring to FIGS. 9 and 10, in the hooking position, the hook-biasing spring 43 exerts a torque on the hook 41 to pivot the hook 41 about the shaft 42, thereby moving the claw 413 upward, away from the nock-receiving hole 103 of the box 100. The stopping portion 415 of the hook 41 is abutted against the connective section 211 of the trigger 21.

Figure 13:
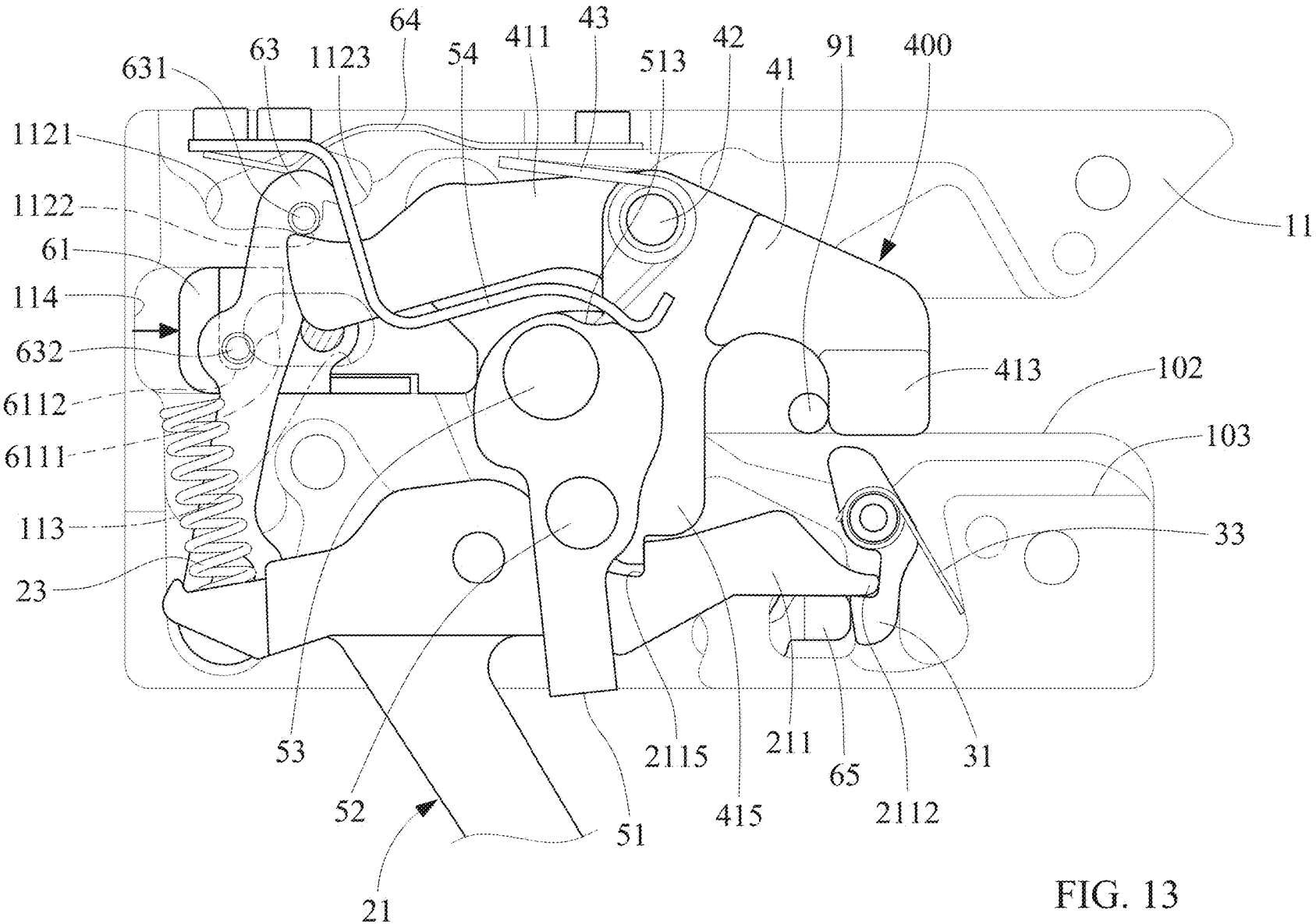
FIG. 13 is a side view of the string-unloading apparatus in another position than shown in FIG. 12.
Figure 14:
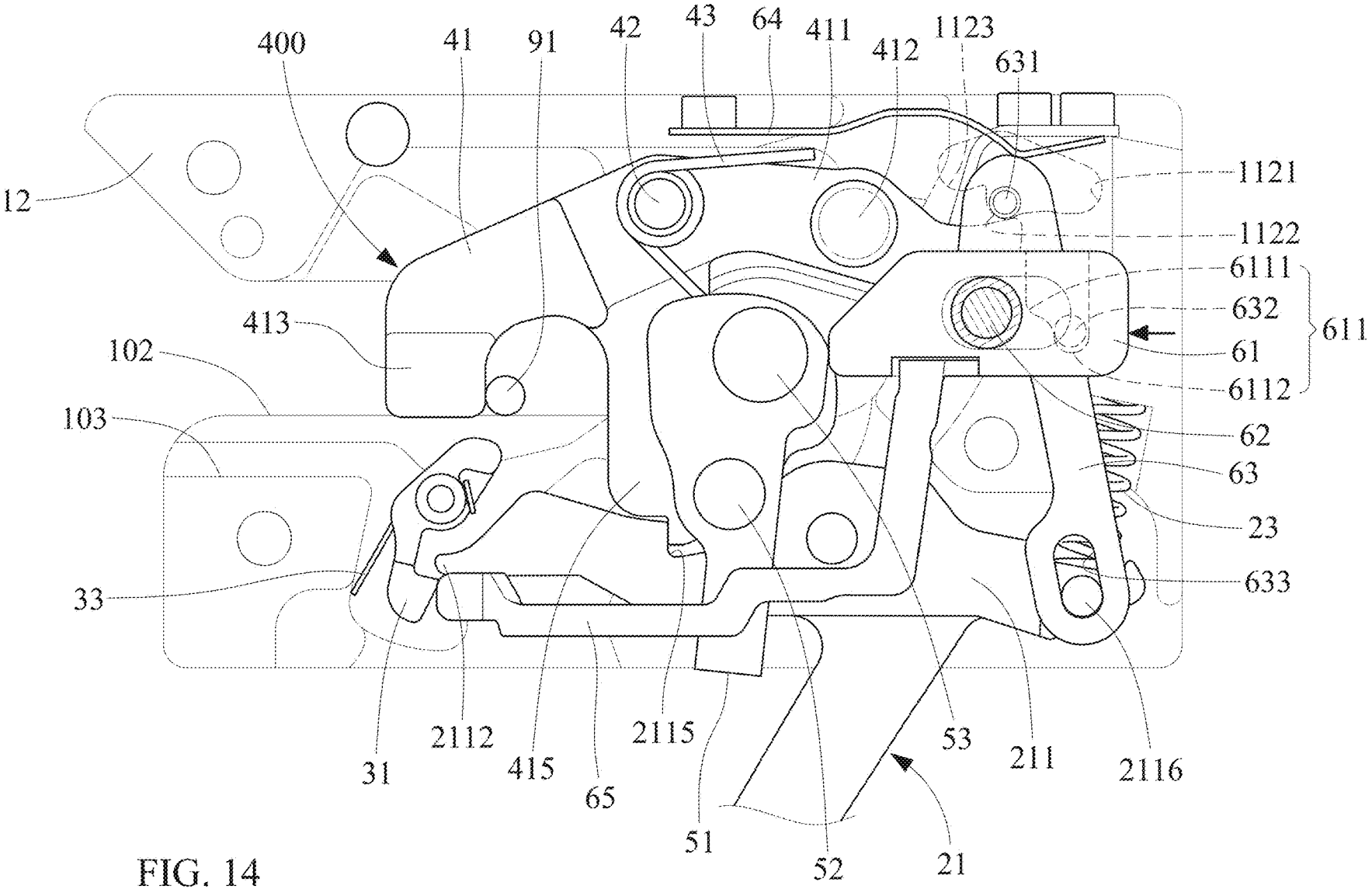
FIG. 14 is a side view of the string-unloading apparatus in another position than shown in FIG. 11.

Referring to FIGS. 13 and 14, in the discharging position, an external torque is exerted on the stopping portion 415 of the hook 41 to trap the stopping portion 415 of the hook 41 in the bore 2115 of the trigger 21. In this process, the hook 41 is pivoted about the third shaft 42 to further load the hook-biasing spring 43. Synchronously, the claw 413 is moved toward the nock-receiving hole 103 of the box 100.

Referring to FIGS. 1 and 3 through 8, the safety unit 500 is operable to restrain the trigger unit 200. The safety unit 500 is movable between a locking position and an unlocking position. The safety unit 500 includes a trigger-hindering element 51, pivots 52, a handle 53 and a leaf spring 54 (FIG. 9).

Referring to FIGS. 7 and 8, the trigger-hindering element 51 is a substantially U-shaped element including two branches between which the connective section 211 of the trigger 21 is located. The branches of the trigger-hindering element 51 are connected to the shells 11 and 12, respectively. Each of the branches of the trigger-hindering element 51 includes an upper orifice an upper orifice 511, a lower orifice 512 and a recess 513. The recess 513 of each of the branches of the trigger-hindering element 51 is cut in an upper portion.

Referring to FIGS. 7 and 8, each of the pivots 52 includes an end connected to the shell 11 or 12 and another end located in the lower orifice 512 of a corresponding one of the branches of the trigger-hindering element 51.

Referring to FIGS. 7 and 8, the handle 53 extends throughout the upper orifice 511 and includes two ends extending from the box 100 via the fletching-receiving slits 102. The handle 53 is operable to pivot the stopping portion 415 of the hook 41. Moreover, the handle 53 is operable to pivot the trigger-hindering element 51 about the pivots 52, thereby moving a lower end of the trigger-hindering element 51 between the locking position against the connective section 211 of the trigger 21 or the unlocking position away from the connective section 211 of the trigger 21.

In use, the handle 53 is subjected to a force from the stopping portion 415 or an external force exerted by the user of the crossbow from the exterior of the box 100. Preferably, the handle 53 consists of two rods 531 and 532.

Figure 4:
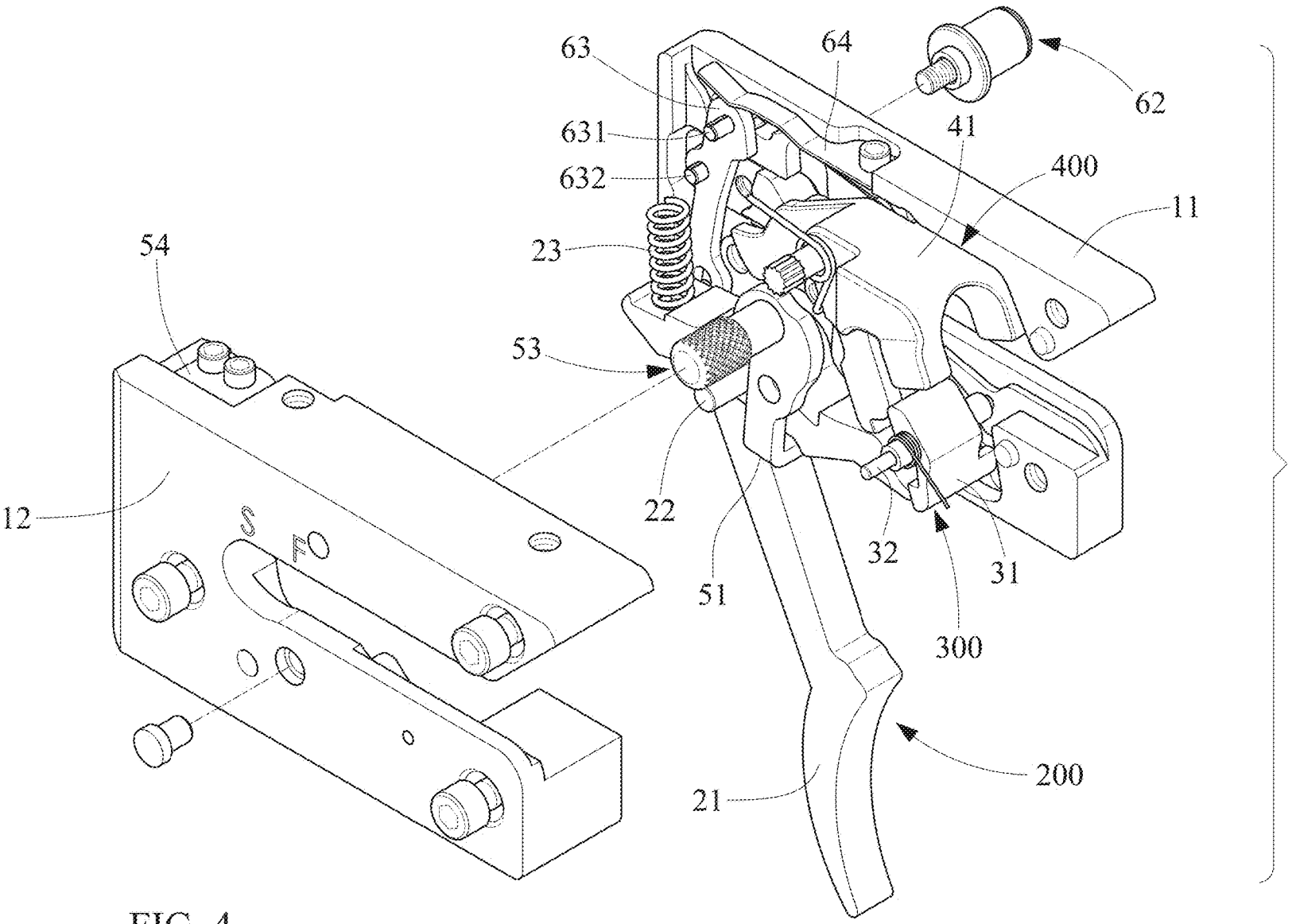
FIG. 4 is another exploded view of the string-unloading apparatus shown in FIG. 1.

Referring to FIGS. 3 through 5, a first end of the leaf spring 54 is connected to an upper portion of the shell 12 by two screws for example in the spring-receiving hole 121. Referring to FIG. 12, a second end of the leaf spring 54 is in contact with the trigger-hindering element 51 in the chamber 101. When the trigger-hindering element 51 is in the locking position, the second end of the trigger-hindering element 51 keeps the trigger-hindering element 51 in the locking position. Referring to FIG. 9, when the trigger-hindering element 51 is in the unlocking position, the second end of the leaf spring 54 is located in the recess 513, allowing the trigger-hindering element 51 to stay in the unlocking position.

Referring to FIGS. 1 through 8, the unloading unit 600 is movable between a no-unlocking position and an unloading position by an external force is exerted. The unloading unit 600 includes a pusher 61, a handle 62, an internal connector 63, a leaf spring 64 and an external connector 65.

Referring to FIGS. 7 and 8, the pusher 61 is movable in and along the pusher-receiving groove 114 of the shell 11. The pusher 61 includes an end for contact with the boss 412 of the hook 41. The pusher 61 includes a stepped pocket 611 and a recess 612.

The stepped pocket 611 is cut in a corner of the pusher 61. The corner of the pusher 61 is located between an upper face of the pusher 61 and a lateral face of the pusher 61. The stepped pocket 611 includes a shallow portion 6111 and a deep portion 6112.

The recess 612 is cut in a lower face of the pusher 61.

Referring to FIGS. 7 and 8, the handle 62 is substantially located out of the shell 11 except for an internal portion extending into the shell 11 via the confining orifice 113. The internal portion of the handle 62 is connected to the pusher 61. Thus, the handle 62 is movable by the user of the crossbow to move the pusher 61 in and along the pusher-receiving groove 114 in the shell 11.

The internal connector 63 is located in the chamber 101. The internal connector 63 includes two pivots 631 and 632 extending from an upper section and a slot 633 cut in a lower section.

The pivot 631 includes a first end located in the irregular hole 112 of the shell 11 and a second end in contact with the shank 411 of the hook 41. The first end of the pivot 631 is movable between the recesses 1121 and 1122 so that the internal connector 63 is movable up and down.

The pivot 632 includes an end located in the stepped pocket 611 of the pusher 61. Normally, the end of the pivot 632 is located in the deep portion 6112 of the stepped pocket 611 so that the pivot 632 is movable with the internal connector 63. The second pivot 632 is movable between the deep portion 6112 of the stepped pocket 611 and the shallow portion 6111 of the same by an external force.

The slot 633 receives the protuberance 2116 of the trigger 21. Thus, the lower section of the pivot 63 moves the protuberance 2116 of the trigger 21 to pivot the trigger 21 when the pivot 631 of the internal connector 63 is moved between the recesses 1122 and 1123.

Referring to FIGS. 6 and 10, the leaf spring 64 includes a rectilinear section connected to an upper portion of the shell 11 in the spring-receiving hole 111 and a bent section on the upper section of the internal connector 63 in the chamber 101, thereby moving the pivot 631 to the recess 1122 (FIG. 14) or the recess 1123 (FIG. 17). The upper section of the internal connector 63 is movable to a position (FIG. 10), another position (FIG. 14) or another position (FIG. 17). As the upper section of the internal connector 63 is in the different positions, the leaf spring 64 exerts different forces on the internal connector 63.

Referring to FIG. 3, the external connector 65 is substantially located in the channel 115, which is cut in the external face of the shell 11. Yet, the external connector 65 includes two ends respectively extending into the chamber 101 via the apertures 116 and 117. The first end of the external connector 65 further extends in the recess 612 of the pusher 61 (FIG. 10). The second end of the external connector 65 is operable to push the restraint 31 of the string-holding unit 300 toward the arrow-on position (FIG. 14).

Referring to FIGS. 9 and 10, in the movement to the anti-unloading position, the pusher 61 is moved away from the claw 413 along the pusher-receiving groove 114. The upper section of the internal connector 63 is moved in a same direction with the pusher 61 because the deep portion 6112 of the stepped pocket 611 receives the pivot 632. The leaf spring 64 presses the internal connector 63 to move the pivot 631 of the internal connector 63 into the recess 1121 from the recess 1123 via the recess 1122.

Referring to FIGS. 13 and 14, in the movement to the unloading position, the pusher 61 is moved toward the claw 413 along the pusher-receiving groove 114. The upper section of the internal connector 63 is moved in a same direction with the pusher 61 because the deep portion 6112 of the stepped pocket 611 receives the pivot 632. The leaf spring 64 is allowed to press the internal connector 63 to move the pivot 631 of the internal connector 63 into the recess 1122 from the recess 1121.

Figure 16:
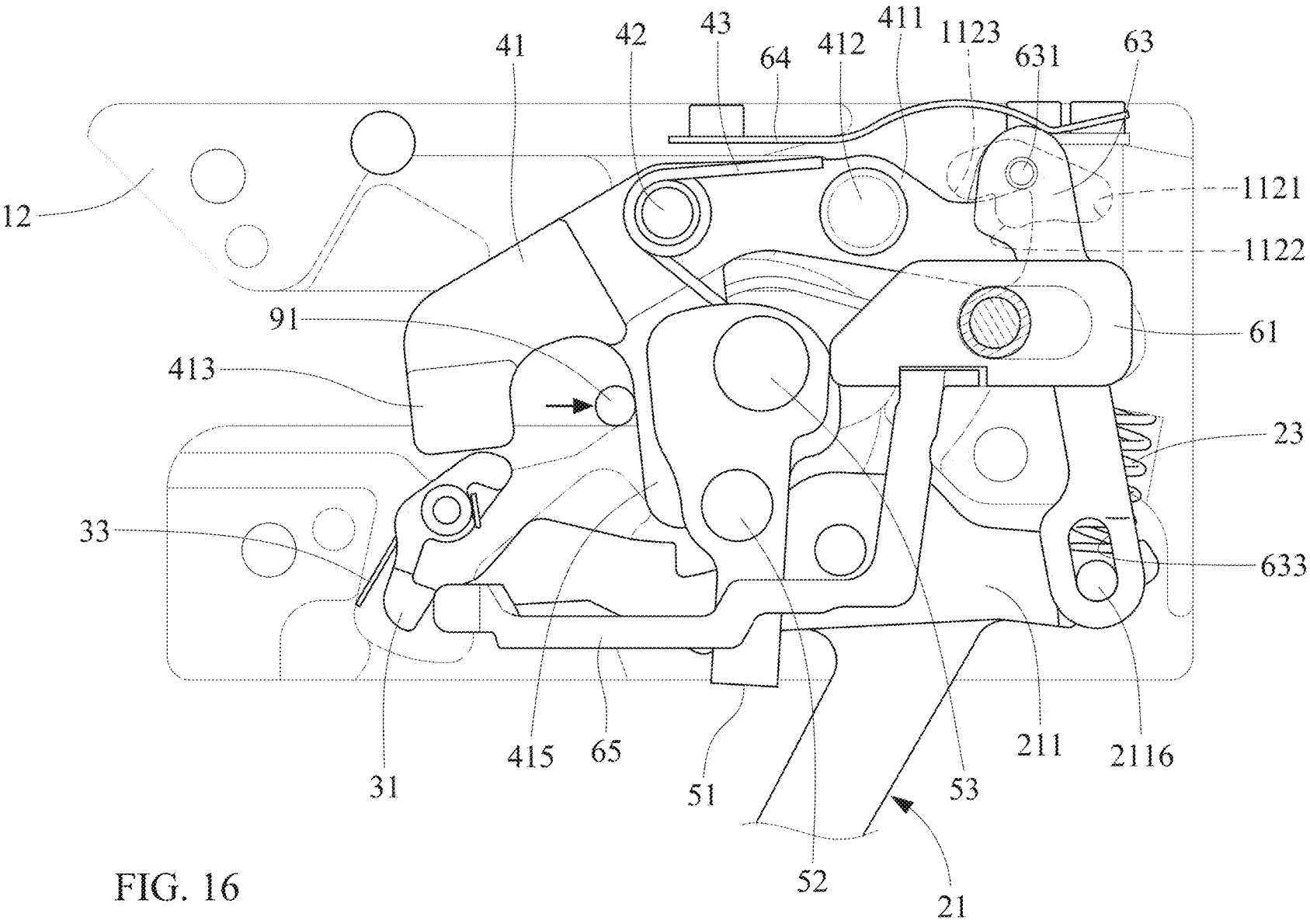
FIG. 16 is another side view of the string-unloading apparatus in another position than shown in FIG. 14.

Referring to FIGS. 16 and 17, in a ready-to-shoot position, the shank 411 of the hook 41 lifts the pivot 631 of the internal connector 63 so that the leaf spring 64 presses the upper section of the internal connector 63 to move the pivot 631 into the recess 1123 from the recess 1122.

Referring to FIGS. 3 through 10, normally, the string-holding unit 300 is in the arrow-off position, the string-hooking unit 400 is in the discharging position, the safety unit 500 is in the unlocking position, and the unloading unit 600 is in the anti-unloading position.

Referring to FIGS. 1 and 7 through 12, the string 91 is loaded and locked. To this end, a cocking device (not shown for being conventional) is used to pull the string 91 into the box 100 through the fletching-receiving slits 102. The string 91 abuts against the stopping portion 415 of the hook 41, thereby pivoting the hook 41 about the shaft 42. The stopping portion 415 of the hook 41 loads the hook-biasing spring 43, and pushes the handle 53 of the safety unit 500, and pivots the trigger-hindering element 51 about the pivots 52 so that the trigger-hindering element 51 abuts against the connective section 211 of the trigger 21. Thus, the trigger 21 cannot be operated. Now, the safety unit 500 has been moved into the locking position from the unlocking position.

Moreover, the stopping portion 415 of the hook 41 is located in the bore 2115 of the trigger 21 to move the string-hooking unit 400 into the hooking position from the discharging position. Now, the hook 41 keeps the string 91 is in the box 100. Hence, the cocking device is allowed to be taken from the string 91.

Referring to FIGS. 11 through 14, the unloading unit 600 is moved to the unloading position from the anti-unloading position. When there is a need to unload the string 91, the handle 62 is operable to move the pusher 61 to the unloading position from the anti-unloading position. The pusher 61 is moved toward the claw 413 along the pusher-receiving groove 114, thereby allowing a portion of the pusher 61 in the stepped pocket 611 to push the second pivot 632 of the internal connector 63 so that the internal connector 63 is moved.

The pivot 631 of the internal connector 63 is moved to the recess 1122 from the recess 1121.

While moved along the pusher-receiving groove 114, the pusher 61 pushes the trigger-hindering element 51 of the safety unit 500 to pivot the trigger-hindering element 51 about the pivots 52 to the unlocking position from the locking position. Synchronously, the pusher 61 causes the external connector 65 to move the restraint 31 so that the restraint 31 loads the restraint-biasing spring 33, thereby rendering the string-holding unit 300 in the arrow-on position.

Figure 15:
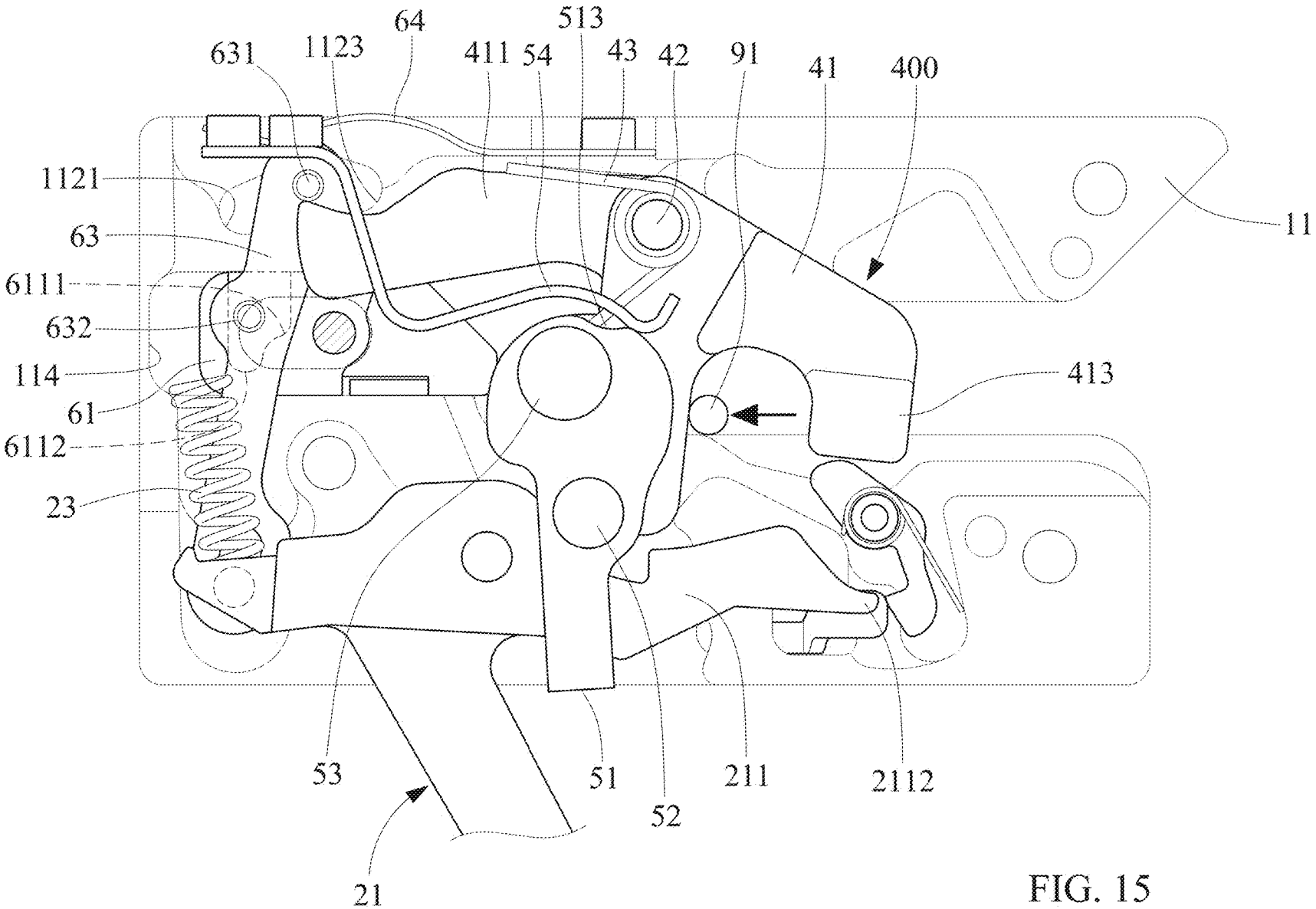
FIG. 15 is a side view of the string-unloading apparatus in another position than shown in FIG. 13.

Referring to FIGS. 15 through 17, the cocking device is operable to mildly pull the string 91 against the topping portion 415 of the hook 41. Thus, a free end of the shank 411 of the hook 41 is lifted, and the pivot 631 of the internal connector 63 is lifted to the height of the third recess 1123 from the height the second recess 1122.

The leaf spring 64 moves the upper section of the internal connector 63 to move the pivot 631 into the recess 1123. Synchronously, the lower section of the internal connector 63 moves the protuberance 2116 of the trigger 21. Thus, the trigger 21 is pivoted about the rod 22. The stopping portion 415 of the hook 41 is moved from the bore 2115 of the trigger 21.

The hook-biasing spring 43 returns the hook 41 to pivot the claw 413 of the hook 41 upward, ready to discharge the string 91. Now, the cocking device is operable to unload the string 91 slowly and easily without any risks of damaging the crossbow or the string 91.

The present invention has been described via illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A string-unloading apparatus comprising:

a box 100 connected to a barrel of a crossbow, wherein the box 100 comprises:

a chamber 101 in the box 100;

two fletching-receiving slits 102 in communication with the chamber 101;

a nock-receiving hole 103 in communication with the fletching-receiving slits 102;

a trigger-receiving slot 104 in communication with the chamber 101;

an irregular hole 112 cut in an internal portion of the box 100 and in communication with the chamber 101, wherein the irregular hole 112 comprises a first recess 1121, a second recess 1122 and a third recess 1123;

a confining orifice 113 in communication with the chamber 101;

a pusher-receiving groove 114 cut in another internal portion of the box 100 and in communication with the chamber 101 and the confining orifice 113;

a trigger unit 200 comprising:

a trigger 21 extending from the chamber 101 via the trigger-receiving slot 104 and comprising a first section formed with a bore 2115 and a second section formed with a protuberance 2116;

a trigger-biasing spring 23 comprising an end in contact with an internal portion of the box 10 and another end in contact with the first section of the trigger 21, thereby pivoting the second section of the trigger 21 upward;

a string-hooking unit 400 comprising:

a hook 41 comprising:

a shank 411 comprising an orifice 4111, a boss 412 in vicinity of an end, and a claw 413 extending from another end;

a stopping portion 415 extending from a middle section of the shank 411 into the bore 2115 of the trigger 21;

a shaft 42 extending throughout the third orifice 4111 to pivotally connect the hook 41 to the box 100;

a hook-biasing spring 43 extending around the shaft 42 and comprising an end in contact with an internal portion of the box 100 and another end in contact with the stopping portion 415, thereby lifting the claw 413;

an unloading unit 600 comprising:

a pusher 61 movable in the pusher-receiving groove 114 and comprising an end for abutment against the boss 412 and a stepped pocket 611 near another end, wherein the stepped pocket 611 comprises a shallow portion 6111 and a deep portion 6112;

a handle 62 comprising an end connected to the pusher 61 and another end extending from the chamber 101 via the confining orifice 113;

an internal connector 63 comprising:

a first pivot 631 extending from a side of the internal connector 63 and movable between the first and third recesses 1121, 1123 via the second recess 1122, wherein the shank 411 is operable to lift the first pivot 631 to the third recess 1123 from the second recess 1122;

a second pivot 632 extending from another side of the internal connector 63 and movable between the shallow and deep portions 6111, 6112 of the stepped pocket 611;

a slot 633 for receiving the protuberance 2116 of the trigger 21 to selectively actuate the trigger 21;

a leaf spring 64 comprising a rectilinear section connected to the box 100 and a bent section in contact with an upper section of the internal connector 63, thereby moving the first pivot 631 between the first and third recesses 1121, 1123 via the second recess 1122.

2. The string-unloading apparatus according to claim 1, wherein the box 100 comprises a spring-receiving hole 111 for receiving the rectilinear section of the leaf spring 64.

3. The string-unloading apparatus according to claim 1, further comprising a safety unit 500 comprising:

a trigger-hindering element 51 comprising:

two lateral sections located on two opposite sides of the connective section 211 and pivotally connected to the box 100 so that the trigger-hindering element 51 is movable between a locking position against the connective section 211 or an unlocking position away from the connective section 211, wherein each of the lateral sections of the trigger-hindering element 51 comprises an orifice 511, wherein one of the lateral sections of the trigger-hindering element 51 comprises a recess 513 in an upper edge;

a handle 53 comprising two sections extending from the nock-receiving hole 103 through the orifices 511 of the trigger-hindering element 51, wherein the handle 53 is selectively in contact with the stopping portion 415;

a leaf spring 54 comprising a first end connected to the box 100 and a second end located in the recess 513 of the trigger-hindering element 51.

4. The string-unloading apparatus according to claim 3, wherein the box 100 comprises a spring-receiving hole 121 for receiving the first end of the leaf spring 54.

5. The string-unloading apparatus according to claim 1, further comprising a string-holding unit 300 comprising:

a restraint 31 comprising a bushing 311;

an axle 32 extending throughout the bushing 311 and comprising two ends connected to the box 100;

a restraint-biasing spring 33 extending around the bushing 311 and comprising an end in contact with an internal portion of the box 100 and another end in contact with a lower section of the restraint 31, thereby lifting the restraint 31 toward the fletching-receiving slits 102.

6. The string-unloading apparatus according to claim 5, wherein the box 100 further comprises a channel 115 cut in another external portion, a first aperture 116 for communicating the channel 115 with the pusher-receiving groove 114, and a second aperture 117 for communicating the channel 115 with the chamber 101, wherein the pusher 61 further comprises a recess 612 cut in a lower portion of the pusher 61, wherein the unloading unit 600 further comprises an external connector 65 extending substantially in the channel 115 and comprising first end extending into the recess 612 of the pusher 61 via the first aperture 116 and a second end extending into the chamber 101 via the second aperture 117, wherein the second end of the external connector 65 is operable for moving the restraint 31, thereby loading the restraint-biasing spring 33.

* * * * *